United States Patent [19]

Penn et al.

[11] Patent Number: 4,846,373

[45] Date of Patent: Jul. 11, 1989

[54] APPARATUS FOR PROPORTIONING OR FOR PROPORTIONING AND MIXING PLURAL DIFFERENT FLUID COMPOSITIONS

[76] Inventors: Laurence R. Penn, 466 Lake Shore Dr., Willard, Ohio 44890; Steven R. Anderson, 6425 Josephine Ave, Edina, Minn. 55435

[21] Appl. No.: 110,038

[22] Filed: Oct. 15, 1987

Related U.S. Application Data

[63] Continuation of Ser. No. 415,884, Sep. 7, 1982, abandoned.

[51] Int. Cl.[4] ..... B67D 5/52

[52] U.S. Cl. ..... 222/137; 222/145; 222/327

[58] Field of Search ..... 222/135–137, 222/94, 145, 387, 484–485, 554, 330–331, 325–327; 239/414, 432

[56] References Cited

U.S. PATENT DOCUMENTS

| | | | |
|---|---|---|---|
| 1,342,450 | 6/1920 | Kost | 222/387 X |
| 1,512,060 | 10/1924 | Schmucker | 222/387 X |
| 1,961,173 | 6/1934 | Schutte et al. | 222/554 X |
| 2,826,339 | 3/1958 | Maillard | 222/137 |
| 2,890,836 | 6/1959 | Gusmer et al. | 239/414 X |
| 3,138,303 | 6/1964 | Hoveland | 222/387 X |
| 3,302,832 | 2/1967 | Hardman et al. | 222/145 X |
| 3,556,348 | 1/1971 | Bristow | 222/137 |
| 3,581,940 | 6/1971 | Cella | 222/94 |
| 3,767,085 | 10/1973 | Cannon et al. | 222/137 X |
| 4,240,566 | 12/1980 | Bergman | 222/135 |
| 4,263,166 | 4/1987 | Adams | 239/414 X |
| 4,271,984 | 6/1981 | Ducros et al. | 222/94 |
| 4,340,154 | 7/1982 | VanManen | 222/94 |
| 4,366,919 | 1/1983 | Anderson | 222/137 |
| 4,432,469 | 2/1984 | Eble et al. | 222/134 |

FOREIGN PATENT DOCUMENTS

| | | | |
|---|---|---|---|
| 428221 | 6/1911 | France | 222/484 |
| 776329 | 6/1934 | France . | |
| 2301306 | 2/1976 | France | 222/389 |
| 495181 | 6/1954 | Italy | 222/145 |
| 86320 | 9/1957 | Netherlands | 222/135 |
| 27016 | 11/1897 | United Kingdom | 239/414 |
| 1102482 | 4/1966 | United Kingdom . | |
| 2064664 | 6/1987 | United Kingdom | 222/137 |

*Primary Examiner*—Michael S. Huppert

*Attorney, Agent, or Firm*—Wenderoth, Lind & Ponack

[57] ABSTRACT

An apparatus for proportioning and dispensing at least two different fluid compositions having different degrees of compressibility includes a cartridge having therein plural separate chambers for containing separate fluid compositions to be proportioned and dispensed. A neck portion is provided at a discharging end of the cartridge. Plural separate passageways extend through the neck portion, each passageway opening into a separate respective chamber. Structure is provided for controlling the flow of the fluid compositions through the respective passageways, for preventing run-on of the fluid compositions through the respective passageways due to decompression of the fluid compositions upon removal of an extruding pressure, and thereby for preventing dispensing of the fluid compositions through the respective passageways in proportional ratios other than a desired predetermined proportional ratio. Such structure includes a valve member having therethrough plural passage portions. The valve member is mounted within the neck portion for movement with respect thereto between an open position, whereat the passage portions are aligned with respective ones of the passageways, thereby permitting extrusion through the passageways of the fluid compositions, and a closed position, whereat the passage portions are out of alignment with the respective passageways and the passageways are blocked by the valve member, thereby preventing any passage of the fluid compositions through the passageways.

13 Claims, 2 Drawing Sheets

APPARATUS FOR PROPORTIONING OR FOR PROPORTIONING AND MIXING PLURAL DIFFERENT FLUID COMPOSITIONS

This application is a continuation of now abandoned application Ser. No. 415,884, filed Sept. 7, 1982.

BACKGROUND OF THE INVENTION

The present invention relates to an apparatus for proportioning or for proportioning and mixing plural different fluid compositions, particularly two different fluid compositions which cure when mixed together and which have different degrees of compressibility.

More particularly, the present invention is directed to such an apparatus employable for the storage, shipping, proportioning, mixing and dispensing of at least two such different fluid compositions.

Unlike hydraulic liquids, most single and multicomponent adhesives, sealants and mastics contain a certain amount of entrained air which becomes mixed into the composition or compositions during formation or compounding thereof. The level of such entrained air may be tolerated or controlled for technical and commercial reasons. Additionally, some forms of fillers employed in such compositions themselves may be compressible. Examples of such compressible fillers are microglass spheres or balloons. Furthermore, air bubbles may be trapped within a cartridge containing the component or components during loading thereof into the cartridge, and such trapped air bubbles will compress and expand during dispensing cycles. The cartridge body may expand and contract due to supported wall clearances or unsupported wall movement.

The result of the above is that, in cooperation with back pressure from the nozzle, some degree of compression of the component or components takes place during the application of pressure to the component or components to dispense the same from the cartridge. Thus, after the power source of dispensing pressure is removed, the component or components are often seen to "run-on" from the nozzle for a certain period of time while decompression takes place. This "run-on" may be used up as part of the material being dispensed for a particular operation or may be allowed to run to waste.

Generally, such run-on does not seriously affect the performance of a cartridge for dispensing a single component material, and the characteristic run-on is accepted as being overridden by the benefits of such a device.

On the other hand, with multicomponent or composition materials, the problem of run-on is multiplied and much more complex, with damaging results to the chemistry of the multicomposition material.

When proportioning only or when proportioning and mixing plural liquid compositions such as reactive adhesive systems from a cartridge, for example a coaxial cartridge arrangement, the chances are high that one fluid composition or material will run-on to a greater or lesser extent than the other compositions or materials. This is due to the factors described above, and additionally due to the fact that the proportioning ratio between the plural compositions adds another factor to the likelihood of unequal compression/decompression. Unlike run-on of a single component material, the results of unequal run-on from the materials of a multicomponent material are that the proportional ratio of the plural compositions at some point in time becomes incorrect.

This causes "off ratio" patches to be dispensed from the cartridge and mixing device, for example an in-line motionless mixer. The results of numerous tests involving multiple cartridge dispensing of various two component reactive systems have determined that only a few such systems remain within tolerance limits of the desired predetermined proportional ratio of mixture of the two components during the starting and stopping periods of flow, and that most such systems result in "off ratio" patches, either visibly or by their performance. Since some specific skill or test procedure would be necessary to control the quality of the mixed composition resulting from the multiple compositions at the starting and stopping points of flow thereof, the benefits of the overall device are reduced, sometimes to the point of being completely unacceptable in practice. Thus, a user dispensing a long bead of adhesive may scrap the first dispensed volume until a visual color change indicative of a proper predetermined proportional ratio has occurred. However, a lower volume user wishing to start and stop for small shots of the mixed composition easily might have his production efficiency substantially reduced by off ratio mixtures. Furthermore, many reactive composition systems are such that there does not occur a visible color change between off ratio and on ratio mixtures. This further adds to the uncertainty of attempting to determine when the mixture is on ratio.

This problem may be reduced to some extent by increasing the mixer and nozzle size, thereby reducing the outlet back pressure. However, large mixers and nozzles generally are not desirable in this type of system.

A more specific explanation of the problem is as follows. Thus, in a two component or composition cartridge system, upon the application of pressure to achieve dispensing, the less compressible material starts flowing through the mixer before the other material while such other material still is compressing. As the compression of the other, more compressible material is increased, the flow of such other material increases to a point where the two materials flow through the mixer in the desired predetermined proportional ratio. Therefore, after an initial off ratio mixture, high proportion of the less compressible material, the mixed composition becomes correct. As soon as the dispensing pressure is removed the less compressible, more hydraulic material ceases to flow more immediately, while the more compressible, less hydraulic material continues to flow, i.e. to run-on. At this point, the more compressible, less hydraulic composition predominates in the mixed composition, and the extent of this predomination is the volume of the more compressible material which should have flowed forward with the less compressible material during the initial starting operation to achieve the desired predetermined proportional ratio. This stopping or final run off now is off ratio. Assuming that the unit is at rest for a period of time to allow complete decompression to take place, it is likely that the mixer will contain an incorrectly high proportion of the more compressible, less hydraulic composition. Therefore, when pressure again is applied to commence dispensing, there first will occur a discharge of a mixture having a high proportion of the more compressible component, and then there will occur discharge of a mixture having a high degree of the less compressible component. The above sequence of events will be repeated during each cycle of starting, stopping and then again starting dispensing, with the exception that upon continued use, the reduced volumes left within the chambers of the cartridge will cause a reduction in the extent of compression/decompression. Economic cartridge sizes are such that the volumes always will be high enough to reflect the above discussed occurrences of off ratio mixtures.

It of course will be understood that it also is desirable in an apparatus for dispensing at least two different fluid compositions that the apparatus be operable in such a manner that flow can be stopped and started immediately with no run-on, whereby small dots, shots of beads can be dispensed accurately.

SUMMARY OF THE INVENTION

With the above discussion in mind, it is the object of the present invention to provide an apparatus for proportioning and dispensing, or for proportioning, mixing and dispensing of at least two different fluid compositions having different degrees of compressibilty. Such apparatus includes a cartridge having therein plural separate chambers for containing separate fluid compositions. A neck portion is provided adjacent a discharging first end of the cartridge. Plural separate passageways extend through the neck portion, each such passageway opening into a separate respective chamber. The simultaneous application of pressure to the fluid compositions in the separate chambers, from a second end of the cartridge toward the first end thereof, causes, in cooperation with a back pressure from the restriction of the passageways, different degrees of compression of the fluid compositions, and causes the fluid compositions to be extruded in a predetermined proportional ratio through the respective passageways. Structure is provided for controlling the flow of the fluid compositions through the respective passageways, for preventing run-on of the fluid compositions through the respective passageways due to decompression of the fluid compositions upon removal of the pressure, and thereby for preventing dispensing of the fluid compositions through the respective passageways in proportional ratios other than the predetermined proportional ratio. This structure includes a valve member having therethrough plural passage portions. The valve member is mounted within the neck portion for movement with respect thereto between an open first position, whereat the passage portions are aligned with respective of the passageways, thereby permitting extrusion through the passageways of the fluid compositions in the predetermined ratio, and a closed second position, whereat the passage portions are out of alignment with the respective passageways and the passageways are blocked by the valve member, thereby preventing any passage of the fluid compositions through the passageways.

By the above structural arrangement, run-on of any of the fluid compositions can be prevented. Thus, movement of the valve member to the closed position thereof closes the passageways and thereby prevents any run-on whatsoever of any of the fluid compositions. Such closing of the passageways also obviously controls the flow of the fluid compositions through the passageways, and additionally such closing of the passageways prevents uneven run-on of the plural fluid compositions, thereby preventing the occurrence of the above discussed off ratio dispensed portions.

The chambers have respective volumes to achieve extrusion of the respective fluid compositions at the desired predetermined proportional ratio.

The neck portion preferably extends forwardly from the first end of the cartridge.

The apparatus may include a mixing and dispensing device connected to the neck portion for receiving the plural fluid compositions extruded through the respective passageways, for mixing the plural fluid compositions to form a mixed composition, and for dispensing such mixed composition. In an advantageous arrangement of the present invention, the mixing and dispensing device may include a nozzle structure removably connected to the outer surface of the neck portion. The nozzle structure may include a nozzle member positioned at the discharge end of the neck portion and having therein fixed mixing elements capable of achieving mixing solely due to the pressure of extrusion of the fluid compositions, and a flanged coupling fitting over a portion of the nozzle member and threaded onto the outer surface of the neck portion, thereby holding the nozzle in position against the neck portion.

Preferably, the valve member is mounted in the neck portion for rotation between the open and closed positions. In an advantageous arrangement, the neck portion includes an enlarged block portion having therethrough an opening transversely interrupting and intersecting the plural passageways. The valve member includes a stem portion rotatably fitted within such opening. The passage portions comprise parallel holes extending through the stem portion in directions transverse to the rotational axis of the stem portion. The stem portion may have a cylindrical configuration. The valve member further may include a head portion integral with a first end of the stem portion at a location exterior of the block portion and having an irregular configuration enabling engagement thereof by a tool for rotation of the valve member. There may be provided means on the head portion for indicating the orientation of the holes and thereby for providing a visual indication of whether the valve member is in the open or closed positions. A second end of the stem portion may have therein a groove at a location exterior of the block portion, and a lock device may fit within the groove for retaining the valve member within the block portion.

In a particularly preferred arrangement of the present invention, the plural separate chambers of the cartridge include a cylindrical first chamber and an annular second chamber coaxially surrounding the first chamber. The first and second chambers respectively contain first and second fluid compositions which cure when mixed together.

BRIEF DESCRIPTION OF THE DRAWINGS

Other objects, features and advantages of the present invention will be apparent from the following detailed description of a preferred embodiment thereof with reference to the accompanying drawings, wherein.

DETAILED DESCRIPTION OF THE INVENTION

Figure 1:
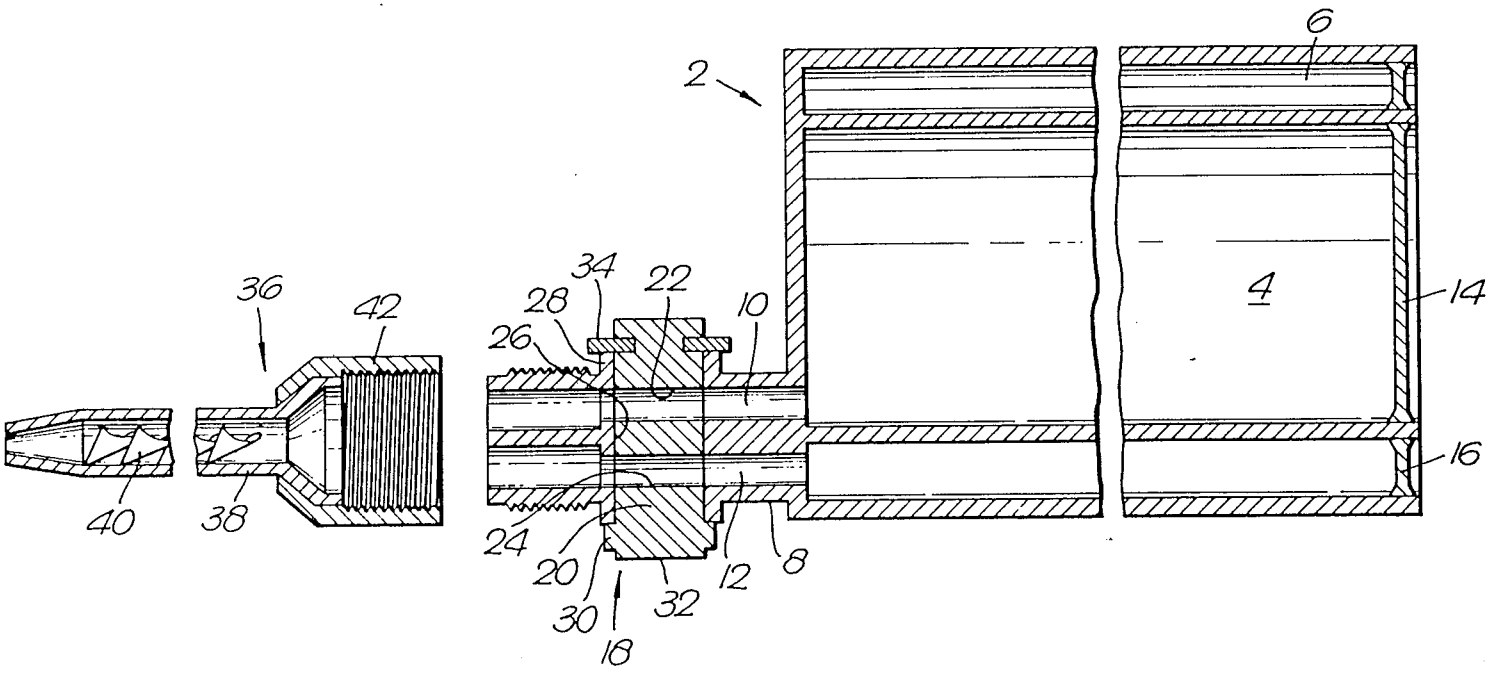
FIG. 1 is a partially exploded longitudinal cross-sectional view of a preferred embodiment of the apparatus of the present invention.

With reference now to the accompanying drawings, a specifically preferred embodiment of the present invention will be described. The specifically described embodiment will be of an apparatus for proportioning, mixing and dispensing two fluid compositions or components which cure when mixed together. Such two components have-different degrees of compressibility, due to the factors discussed above. The two fluid compositions may be components of a known adhesive, sealant or mastic system, as well as other systems the components of which cure when mixed together, as will be apparent to those skilled in the art. It is to be understood however that the present invention is not intended to be limited to a two component system, but is employable for a system capable of proportioning, mixing and dispensing of more than two components. Furthermore, it is intended that the present invention be directed to an apparatus for proportioning and dispensing plural fluid compositions, as well as to an apparatus for proportioning, mixing and dispensing plural fluid compositions.

The apparatus of the invention includes a cartridge, generally indicated at 2 and having therein a a first, for example cylindrical, chamber 4 surrounded by a second, for example annular chamber 6. The two chambers are entirely separate from each other and contain respective fluid compositions or components which cure when mixed together and which have different degrees of compressibility. A neck portion 8 extends forwardly from a discharge end of the cartridge 2. Neck portion 8 has extending therethrough first and second passageways 10, 12 opening into respective of the chambers 4 and 6. Second ends of the chambers 4 and 6 are sealed and closed by respective closure members 14, 16.

Upon the simultaneous application of pressure to the closure members 14, 16, and thereby to the fluid compositions in chambers 4, 6 respectively, the fluid compositions are urged toward the discharge end of the cartridge. Due to a back pressure created by the restriction of passageways 10, 12, as well as to a mixing device, to be discussed in more detail below, which may be attached to the neck portion 8, the two fluid compositions tend to be compressed. Such compression occurs due to the reasons discussed above. However, the two compositions have different degrees of compressibility. With passages 10, 12 open, the less compressible material will begin to discharge first through the respective passageway thereof. Initially, the more compressible fluid composition still will be compressing and the discharging through the respective passageway thereof will be retarded until after the compression thereof is achieved. After this initial off ratio situation, upon continued application of extrusion pressure, the two fluid compositions will be extruded in a desired predetermined proportional ratio through the respective passageways 10, 12. However, upon removal of the extrusion pressure, the two fluid components will tend to decompress, thereby resulting in run-on as discussed above. Furthermore, due to the different degrees of compressibility of the two fluid compositions, the extent of such run-on will be different. This results in the off ratio portions discussed above.

In accordance with the present invention, there is provided structure for controlling the flow of the two fluid compositions through passageways 10, 12, for preventing run-on of the two fluid compositions through the respective passageways 10, 12 due to decompression of the fluid compositions upon removal of the extrusion pressure, and thereby for preventing dispensing of the two fluid compositions through the respective passageways 10, 12 in proportional ratios other than the predetermined proportional ratio. More specifically, in accordance with the present invention, such structure includes a valve member generally indicated at 18. The valve member 18 includes a stem portion 20, preferably cylindrical in shape, rotatably mounted within neck portion 8. Stem portion 20 has extending therethrough first and second passage portions in the form of holes 22, 24. Valve member 18 is rotatable, whereby stem portion 20 is sealingly rotatable within an opening 26 extending through an enlarged block portion 28 of neck portion 8. More specifically, valve member 18 is rotatable with respect to block portion 28 between an open position, illustrated in FIGS. 1 and 3, whereat passage portions 22, 24 are aligned with respective passageways 10, 12, thereby permitting extrusion through the passageways of the fluid compositions in the desired predetermined proportional ratio, and a closed position, illustrated in FIG. 2, whereat the passage portions 22, 24 are out of alignment with the respective passageways 10, 12 and the passageways 10, 12 are blocked by the valve member, thereby preventing any passage of the fluid compositions through the passageways.

The valve member has at a first en thereof a head portion 30 integral with stem portion 20 at a location exterior of block portion 28 and having an irregular configuration, such as a hexagonal configuration, enabling engagement thereof by a tool for rotation of the valve member. An alignment device, such as straight line indicator 32, may be provided on head portion 30 to indicate the orientation of holes 22, 24 and thereby for providing a visual indication of whether the valve member is in the open or closed positions. A second end of stem portion 20 may have therein a groove at a location exterior of the block portion 28, and a suitable element, such as a lock ring 34, may be fitted within such groove for retaining the valve member 18 within block portion 28.

Figure 2:
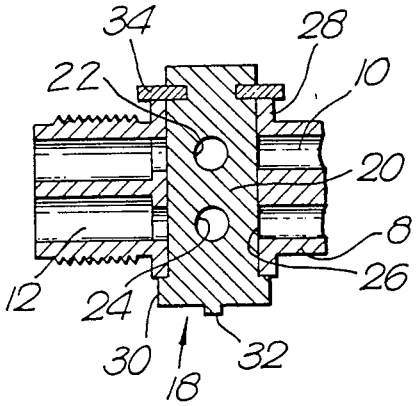
FIG. 2 is a partial cross-sectional view of a portion of FIG. 1, but wherein a valve member in accordance with the present invention is rotated 90 degrees with respect to the position thereof shown in FIG. 1.
Figure 3:
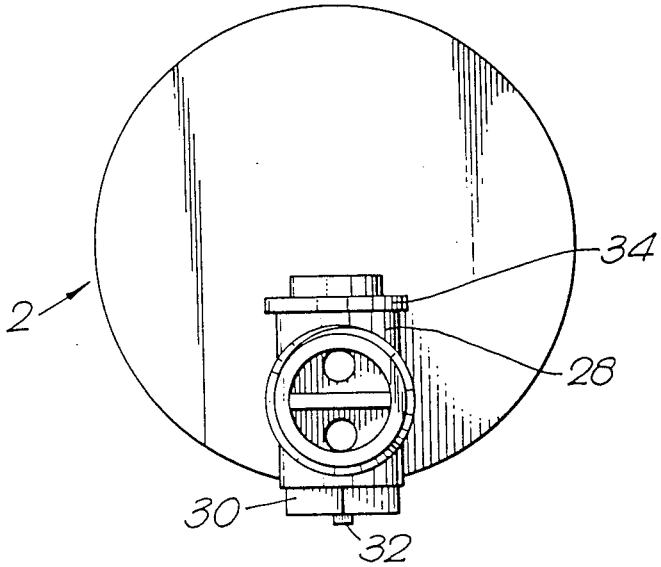
FIG. 3 is an end view of the apparatus, as viewed from the left end of FIG. 1, without the mixing nozzle being illustrated.

It will be apparent that by rotation of the valve member 18 from the position shown in FIG. 1 to the position shown in FIG. 2, all passage of the fluid compositions through the passageways 10, 12 will be stopped. This prevents any run-on, unequal run-on of the two compositions, and resultant off ratio patches, as discussed above.

In accordance with a further feature of the present invention, there is provided a mixing and dispensing structure, shown generally at 36 in FIG. 1, connected to neck portion 8 for receiving the plural fluid compositions extruded through the respective passageways 10, 12, for mixing such plural fluid compositions to form a mixed composition at the desired predetermined proportional ratio, and for dispensing such mixed composition. Such structure includes a nozzle removably connected to the outer surface of neck portion 8. Specifically, a nozzle member 38 is positioned at the discharge end of neck portion 8 and has therein fixed mixing elements 40 capable of achieving mixing solely due to the pressure of extrusion of the fluid compositions. A flanged coupling 42 fits over a portion of nozzle member 38 and is threaded onto the outer surface of neck portion 8, thereby holding the nozzle member 38 in position against the neck portion. The mixing and dispensing structure 36 is intended to be an in-line motionless mixing device. It will be apparent from the structure illustrated in FIG. 1, that the two fluid compositions do not come in contact until they are discharged into the interior of nozzle member 38. Thereby, the two fluid compositions do not mix and cure in an area causing locking of the structure 36 on the neck portion 8, and the structure 36 may readily be removed when desired. The two fluid compositions never mix within the internal structure of the cartridge 2, the neck portion 8 and the valve member 18.

Although the present invention has been described and illustrated with regard to a preferred embodiment thereof, it is to be understood that many structural modifications may be made to the specifically described and illustrated arrangement without departing from the scope of the present invention. It specifically is to be understood that it is contemplated that the cartridge structure, the neck portion structure, the closure member structure, and the mixing and dispensing nozzle structure may be as disclosed in U.S. patent application Ser. No. 31,789, filed Apr. 20, 1979, now U.S. Pat. No. 4,366,919. Furthermore, it is intended that the apparatus of the present invention be employable with any suitable arrangement for applying the extruding pressure to the multiple fluid compositions. Such extruding pressure applying devices may be, for example, as disclosed in such U.S. Pat. No. 4,366,919. The disclosure of U.S. Pat. No. 4,366,919 is hereby incorporated by reference.

What we claim is:

1. An apparatus for the proportioning and dispensing of at least two different fluid compositions having different degrees of compressibility, said apparatus comprising:

a cartridge having therein plural separate first and second chambers for containing separate fluid compositions to be proportioned and dispensed, said chambers being isolated from each other within said cartridge;

said first and second chambers respectively comprising first and second fluid compositions which cure when mixed together, said first and second fluid compositions having different degrees of compressibility due to factors including the inclusion therein of air and/or fillers;

a neck portion provided at a discharging first end of said cartridge;

plural separate passageways extending through said neck portion, each said passageway opening into a separate respective said chamber;

whereby, the simultaneous application of pressure to said fluid compositions in said separate chambers, from a second end of said cartridge toward said first end thereof, causes, in cooperation with a back pressure from the restriction of said passageway, expansion of the walls of said cartridge and different degrees of compression of said fluid compositions, and causes said fluid compositions to be extruded in a predetermined proportional ratio through the respective said passageways; and means for controlling the flow of said fluid compositions through the respective said passageways, for preventing run-on of said fluid compositions through said respective passageways due to contraction of said walls of said cartridge and decompression of said fluid compositions upon removal of the pressure, and thereby for, upon reapplication of the pressure, preventing dispensing of said fluid compositions through said respective passage in proportional ratios other than said predetermined proportional ratio due to differing degrees of compressibility of said fluid compositions, said controlling and preventing means comprising a valve member having therethrough plural separate passage portions, said valve member being mounted within said neck portion for movement with respect thereto between an open first position, whereat said passage portions are aligned with respective said passageways, thereby permitting extrusion through said passageways of said fluid compositions in said predetermined proportional ratio, and a closed second position, whereat said passage portions are out of alignment with said respective passageways and said passageways are blocked by said valve member, thereby preventing any passage of said fluid compositions through said passageways.

2. An apparatus as claimed in claim 1, wherein said chambers have respective volumes to achieve extrusion at said predetermined proportional ratio.

3. An apparatus as claimed in claim 1, wherein said neck portion extends forwardly from said first end of said cartridge.

4. An apparatus as claimed in claim 1, further comprising mixing and dispensing means connected to said neck portion for receiving said plural fluid compositions extruded through the respective said passageways, for mixing said plural fluid compositions to form a mixed composition, and for dispensing said mixed composition.

5. An apparatus as claimed in claim 4, wherein said mixing and dispensing means comprises a nozzle structure removably connected to the outer surface of said neck portion.

6. An apparatus as claimed in claim 5, wherein said nozzle structure comprises a nozzle member positioned at the discharge end of said neck portion and having therein fixed mixing elements capable of achieving said mixing solely due to said pressure of extrusion of said fluid compositions, and a flanged coupling fitting over a portion of said nozzle member and threaded onto said outer surface of said neck portion, thereby holding said nozzle member in position against said neck portion.

7. An apparatus as claimed in claim 1, wherein said valve member is mounted in said neck portion for rotation between said open and closed positions.

8. An apparatus as claimed in claim 7, wherein said neck portion includes an enlarged block portion having therethrough an opening transversely interrupting said plural passageways, and said valve member includes a stem portion rotatably fitted within said opening, said passage portions comprising parallel holes extending through said passage portions comprising directions transverse to the rotational axis of said stem portion, said passage portions aligning at opposite ends thereof with said interrupted passageways when said stem portion is in said first position.

9. An apparatus as claimed in claim 8, wherein said stem portion has a cylindrical configuration.

10. An apparatus as claimed in claim 8, wherein said valve member further includes a head portion integral with a first end of said stem portion at a location exterior of said block portion and having a configuration enabling engagement thereof by a tool for rotation of said valve member.

11. An apparatus as claimed in claim 10, further comprising means on said head portion for indicating the orientation of said holes and thereby for providing a visual indication of whether said valve member is in said open or closed positions thereof.

12. An apparatus as claimed in claim 10, wherein a second end of said stem portion has therein a groove at a location exterior of said block portion, and further comprising lock means fitting within said groove for retaining said valve member within said block portion.

13. An apparatus as claimed in claim 1, wherein said plural separate chambers comprise a cylindrical first chamber and an annular second chamber coaxially surrounding said first chamber.

* * * * *